US005218774A

United States Patent [19]

Mullins

[11] Patent Number: 5,218,774

[45] Date of Patent: Jun. 15, 1993

[54] FRAME FLOWER DISPLAY

[76] Inventor: Sheelagh J. Mullins, P.O. Box 436, Cordova, Ak. 99574

[21] Appl. No.: 901,724

[22] Filed: Jun. 22, 1992

Related U.S. Application Data

[63] Continuation-in-part of Ser. No. 648,961, Jan. 31, 1991.

[51] Int. Cl.[5] ..... A47G 7/02; A47G 1/00

[52] U.S. Cl. ..... 40/152; 40/160; 47/41.01

[58] Field of Search ..... 40/152, 152.1, 160; 47/41.01; 428/13, 913.3, 912.2, 26, 14

[56] References Cited

U.S. PATENT DOCUMENTS

| | | | |
|---|---|---|---|
| 183,530 | 10/1876 | Birge . | |
| 367,899 | 8/1887 | Ecker . | |
| 1,777,944 | 10/1930 | Trovato . | |
| 1,885,879 | 11/1932 | Whittington | 40/160 |
| 2,354,622 | 7/1944 | Swartz | 428/913.3 |
| 2,686,988 | 8/1954 | Garber | 40/152 |
| 3,763,997 | 10/1973 | Willinger et al. | 40/160 |
| 4,014,134 | 3/1977 | Womack, Jr. . | |
| 4,212,133 | 7/1980 | Lufkin | 40/152 |
| 4,353,327 | 10/1982 | Shroyer | 40/160 |
| 4,584,213 | 4/1986 | Rentowl . | |
| 4,917,240 | 4/1990 | Roberts et al. . | |
| 5,057,344 | 10/1991 | Mealey | 428/13 |

*Primary Examiner*—James R. Brittain
*Assistant Examiner*—Cassandra Hope
*Attorney, Agent, or Firm*—Richard C. Litman

[57] ABSTRACT

A frame flower display is provided which includes: a frame mountable upon a vertical support surface; a watertight container removably fitted within the frame for holding the stems of a floral arrangement and for providing water to retain the freshness of the flowers; and two upright panels, the first concealing the container from view and the second forming the rear closure of the display. The container has an elevated ridge about its side and lower surfaces permitting easy manipulation thereof and reducing the area of contact between the container and the frame thereby eliminating potential water damage. Decorative fabric coverings joined to the frontal portions of the upright panels provide a floral arrangement with the appearance, to the casual observer, that such is floating or hovering before the display without any apparent means of attachment.

10 Claims, 4 Drawing Sheets

FIG. 1
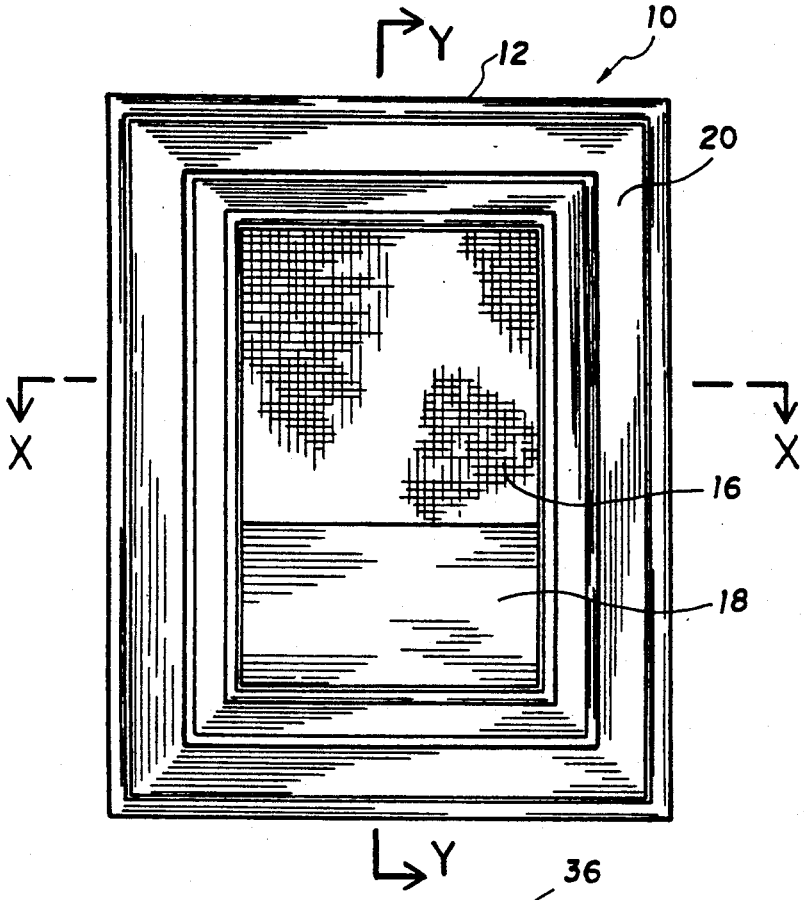
FIG. 2
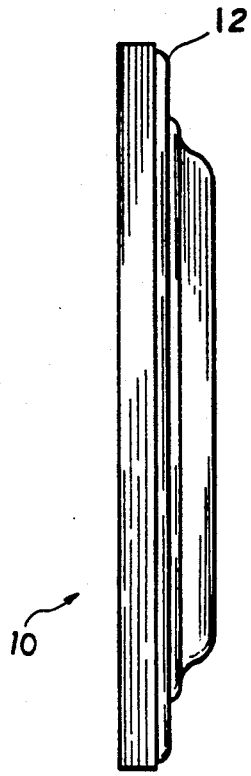
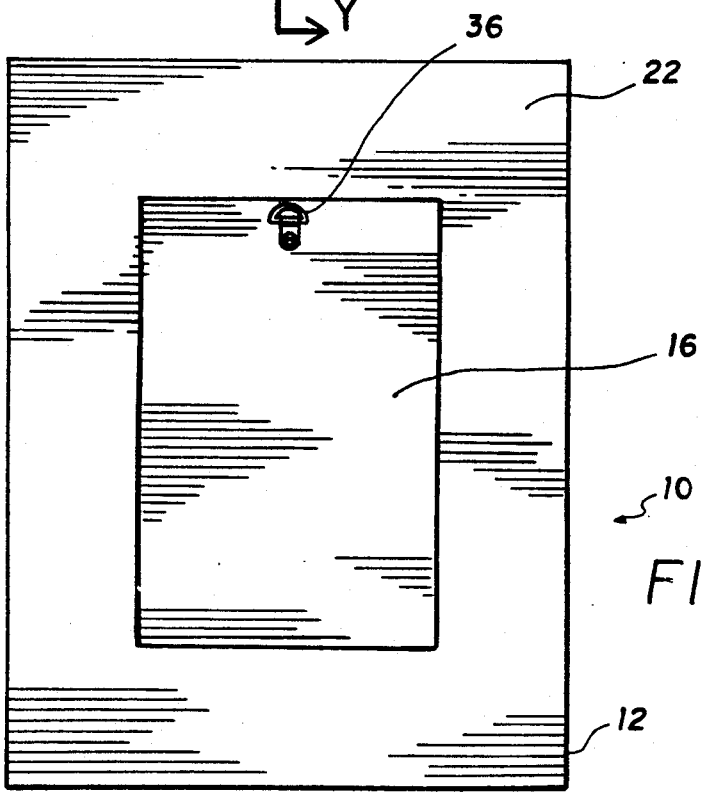
FIG. 3

FRAME FLOWER DISPLAY

This application is a continuation in part of application Ser. No. 07/648,961 filed Jan. 31, 1991.

FIELD OF THE INVENTION

The present invention relates to flower holders and particularly to a holder which may be suspended from a vertical support for the display of natural or simulative flowers and other plant materials.

BACKGROUND OF THE INVENTION

Decorative flower arrangements have been displayed in dwelling houses for ages. Perhaps the high point of the home flower arranging trend occurred, however, during the Victorian Age of one hundred years ago when no fashionable dwelling was considered complete without at least one flower display joined to an interior wall. In that time, flower containers were permanently affixed to their supporting surfaces making access for watering purposes difficult and marking the spillage of water a likely occurrence. Over time, detachable glass containers of different styles wound their way into the mainstream thereby solving some of the problems inherent in their predecessors.

Glass flower displays developed rapidly. The original glass containers, too small to hold any but the smallest of flowers, were replaced by larger displays having expensive metal coverings capable of hiding both flower stems and water reservoirs. After deliberation, it was determined by many individuals of the time that only large flowers presented a pleasing appearance in the new and larger displays. Unfortunately, these displays, burgeoning with large amounts of vegetation, would often become unbalanced and pour their contents onto Victorian floors and walls. These problems, however, gradually disappeared without solution as fashions changed and wall displays faded from view.

Today, it can be hardly be argued that certain Victorian sensibilities have once again become fashionable with the social mainstream. Beyond the stuffiness, perceived by some, in the growing American middle-class, there has been a modest revival of the ornamented architecture, decor, and furnishings popular in 19th-century life. Once again, flowers are finding their way back into the home and onto interior walls for decorative purposes. To prevent the problems presented to our Victorian forefathers, the present invention is directed to a wall display which can be easily attended to and is unlikely to spill.

DESCRIPTION OF THE RELATED ART

Apparatus for exhibiting flowers and the like have seen some development over the years. Most recently, the advent of improved cardboard materials, water resistant coatings, and a hard foamed plastics material such as that sold under the Registered Trademark "Oasis" which will retain water and into which the stem of a flower may be inserted, have produced greeting cards having flower retaining means. Few developments, however, have been directed toward the exhibition of freshly cut flowers upon a vertical support such as a wall.

U.S. Pat. No. 183,530, issued Oct. 24, 1976 to Isidore Birge, disclosures a box for artificial flowers having on its bottom a plurality of inclined beds. Sockets of tapering shape for receiving, gathering, and holding the stems of the flowers are provided in each of the beds. As the invention is directed toward a display for artificial flowers, it has not been provided with container means adapted to hold liquid materials required to retard the otherwise rapid decay of freshly cut, natural flowers.

U.S. Pat. No. 367,899, issued Aug. 9, 1987 to John W. Ecker, for a relief picture and frame capable of displaying small shrubs, trees, or other objects behind a glass cover plate. To replace the displayed items, access to the interior of the frame is necessary and can only be achieved by removal of the frame from its supporting surface.

U.S. Pat. No. 1,777,944, issued Mar. 20, 1930 to Charles Trovato, describes an illuminated aquarium framed to give the effect of a picture and adapted to be mounted upon a wall. Located within the lower portion of the apparatus is a container adapted to hold water and fully exposed to view. Fluid feed and drainage tubes are provided for aquarium filling and overflow purposes. Additionally, these tubes provide spacing elements for the lower portion of the tapered, box-like body of the apparatus retaining such at a measurable distance from the surface of the supporting wall.

U.S. Pat. No. 4,014,134, issued Mar. 29, 1977 to W. Victor Womack, Jr., provides a package for transporting and displaying certain types of plant materials comprising a substantially rectangular cardboard base to which a transparent cover may be joined in order to provide a substantially air-tight plant-receiving chamber.

U.S. Pat. No. 4,584,213, issued Apr. 22, 1986 to Patricia L. Rentowl, shows a commemorative card provided with a block of hard foamed plastics material capable of containing water and into which the stems of flowers may be inserted.

U.S. Pat. No. 4,917,240, issued Apr. 17, 1990 to Therese L. Roberts et al, discloses a floral greeting card which may be expanded into a rigid hollow receptacle having an angled front face. Inserted in the bottom of the receptacle is a block of treated foam material for securely holding the stems of a floral arrangement.

None of the above inventions and patents, taken either singly or in combination, is seen to describe the instant invention as claimed.

SUMMARY OF THE INVENTION

It is the principal object of the present invention to provide a picture frame-like display, for attachment to a vertical support, capable of retaining a plurality of flowers of various sizes in a stable manner.

It is another object of the invention to provide a frame flower display for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The present invention will be more particularly described with reference to the accompanying diagrammatic drawings, in which:

FIG. 1 is a front elevational view of a frame flower display in accordance with the present invention, FIG. 2 is a side elevational view thereof, FIG. 3 is a rear elevational view thereof.

Similar reference characters denote corresponding features consistently throughout the attached drawings.

DETAILED DESCRIPTION OF THE PREFERRED EMBODIMENT

Referring now to the embodiment of the invention shown in the figures by way of example only, FIGS. 1, 2, 3, and 5 show a frame flower display 10 securable to a vertical support surface. Display 10 has four major components: frame 12, watertight container 14, and upright panels 16 and 18. When assembled and mounted upon a vertical support, display 10 is capable of retaining an arrangement of freshly cut flowers in an upright and stable manner, the stems of such flowers resting in a container filled with water to retain the freshness thereof.

Figure 6:
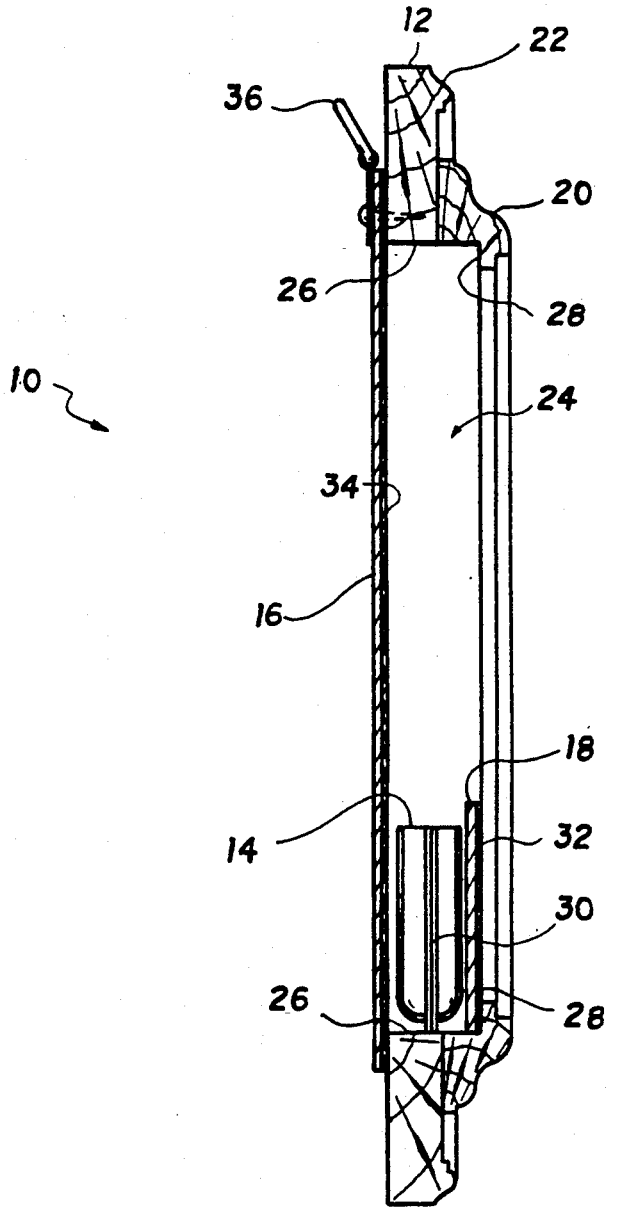
FIG. 6 is a vertical cross sectional view through line Y—Y' of FIG. 1.

In the preferred embodiment, frame 12 is constructed of two separate wooden subframes 20 and 22 joined together to create an artistic and pleasing appearance. Each of subframes 20 and 22 comprises a suitable thin and decorative molding material assembled like an ordinary four-sided picture frame. The molding utilized in the preferred embodiment is of wood which is easily worked, exhibits great durability and strength, and is water resistant when finished with appropriate sealants well known in the art. Other materials, exhibiting similar characteristics, such as: plastic, plaster, aluminum and fiberglass may be employed within subframes 20 and 22 of the inventive display with equal facility. When joined together, subframes 20 and 22 form a rectangular housing for container 14. This housing may be seen clearly in FIG. 6 and is defined by two vertical walls as at 24, two horizontal walls as at 26, and a flanged lip or edge 28 forming a raised retaining surface along the perimeter of the front thereof.

Figure 4:
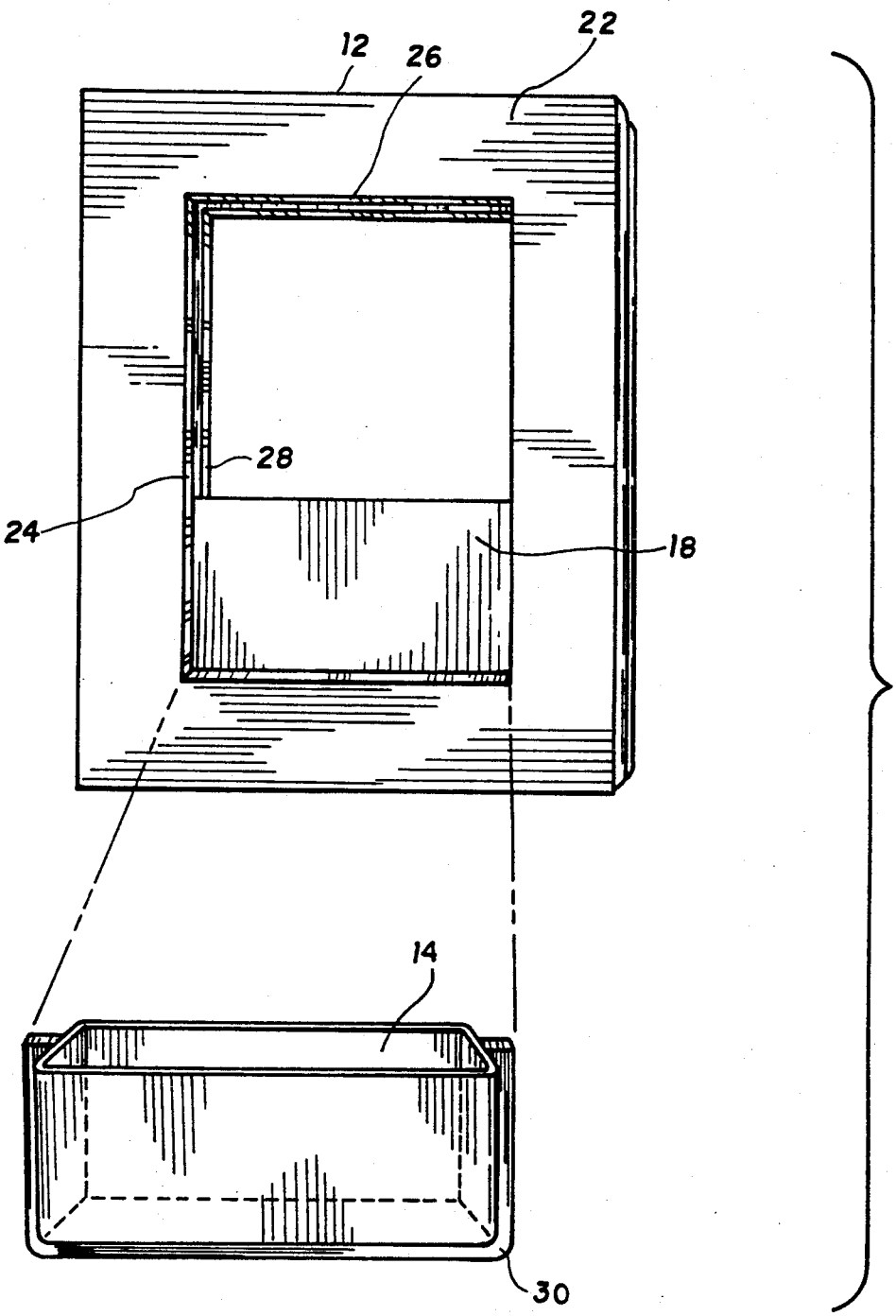
FIG. 4 is a rear perspective view of the display of FIG. 1, partially assembled, showing container support detail.
Figure 5:
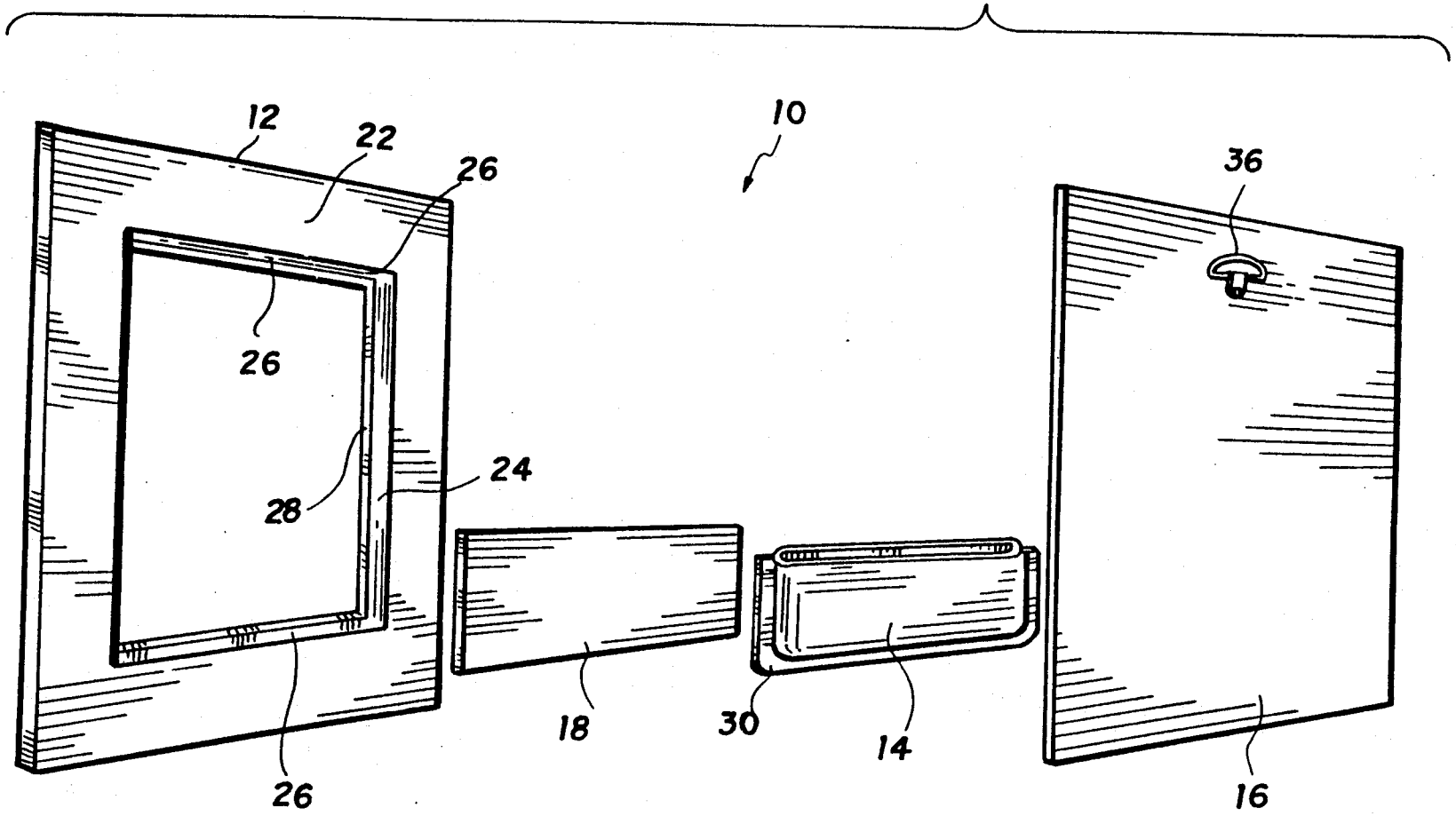
FIG. 5 is a rear perspective view of the display of FIG. 1 exploded to show details thereof.
Figure 7:
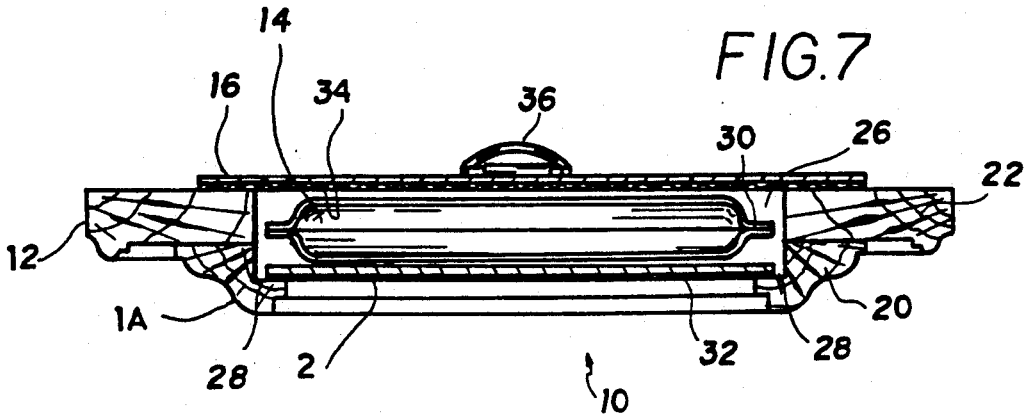
FIG. 7 is a horizontal cross sectional view through line X—X' of FIG. 1.

When in use, watertight container 14 rests within frame 12 and the rectangular housing formed thereby. Container 14, having an open top, is constructed of plastic, metal, glass, or other impermeable material, is adapted to hold water and corresponds in shape to the lower portion of the housing. As may be seen in FIGS. 6 and 7, the width and length dimensions of container 14 are substantially similar to those of the housing in order to retain such in an upright orientation without substantial movement thereof. Generally, however, the dimensions of container 14 are slightly smaller than those of the housing to allow for its easy removal for cleaning purposes, see FIG. 4, and to accommodate upright panel 18. Container 14 has an elevated ridge 30 about its side and lower surfaces permitting container 14 to be easily grasped by the hand for insertion and removal purposes. Additionally, ridge 30 reduces the area of contact between container 14 and walls 24 and 26 thereby permitting water inadvertently spilled therefrom to evaporate quickly without unnecessary damage to frame 12.

Providing support to container 14 are upright panels 16 and 18. First panel 18 is vertically retained within the lower portion of frame 12 by flanged edge 28. Panel 18 may be constructed of cardboard, wood, plastic, or rigid foam materials. In the preferred embodiment, the fit between panel 18 and frame 12 is one of close tolerances whereby friction will retain panel 18 in a vertical orientation within frame 12 regardless of the orientation of display 10. It is anticipated, however, that panel 18 may be joined to frame 12 with other fastening means including: well-known adhesives, staples, clips, and threaded fasteners. Panel 18 has a height substantially equivalent to that of container 14. In the preferred embodiment, panel 18 is rectangular in shape and has a height equal to, or somewhat greater than, the height of container 14 such that when display 10 is utilized for flower exhibition purposes, container 14 is not visible to the casual observer. Panel 18 may be provided with decorative ornamentation such as fabric covering 32 fastened thereto. Whereas panel 18 is joined to the front of display 10, second upright panel 16 is removably joined to, and forms a rear closure for, display 10. The joining of panel 16 to frame 12 may be accomplished by any means known in the picture framing art including adhesive tape. By removably joining panel 16 and frame 12, access to container 14 for cleaning or rewatering purposes is provided. Although not shown in the figures, access to container 14 may be provided in any one of a number of alternative ways. For instance, panel 16 could be pivotally joined to the uppermost portion of frame 12 thereby permitting panel 16 to rotate upon the application of a torque about the pivot axis. Regardless of the method of attachment, upright panel 16 may be constructed of the same materials utilized in panel 18 and ornamented in a similar fashion with fabric covering 34 fastened thereto. When coverings 32 and 34 are of matching materials in terms of color and texture, flowers exhibited in display 10 will appear to the casual observer to float or hover before frame 12 without any apparent means of attachment to display 10. A well-known hook 36 is joined to the rear surface of panel 16 to retain display 10 in a vertical orientation upon an upright support.

To utilize display 10 for the purposes of exhibiting freshly cut flowers, a suitable volume of fresh water must first be added to container 14. Only minimal care is required to fill container 14 which may be either removed from frame 12 for filling from a household tap or left in place and filled from a source having an appropriately sized spigot. As every indoor gardener knows, the level of water added to container 14 must be kept below the top of container 14 so that the volume of water displaced by flower stems inserted into container 14 does not cause the water to overflow. Once water has been added, container 14 may be inserted into frame 12 from the front and placed upon the lower horizontal surface or wall 26. Upright panel 16 is then joined to frame 12, in the manner previously described, thereby retaining container 14 in an upright orientation. Cut flowers may next be added by inserting their stems into water-filled container 14. The narrowness of container 14 assists in retaining said flowers in an upright orientation by preventing such from tilting forward or backward. When display 10, now having flowers therein, is moved to a wall, or other vertical support, to be hung from hook 36 for exhibition purposes it is important to retain the flowers in the manner in which they were originally arranged to save time and effort.

It is to be understood that the present inventive frame flower display is not limited to the sole embodiment described above, but encompasses any and all embodiments within the scope of the following claims.

I claim:

1. A frame flower display for exhibiting and retaining a floral arrangement upon a vertical support surface, comprising:

a frame;

a watertight container removably fitted within said frame and adapted to receive stems of a floral arrangement, said watertight container further including an elevated ridge about its side and lower surfaces;

a first upright panel vertically retained within said frame; and concealing said container from view; and, a second upright panel removably joined to said frame and forming the rear closure thereof.

2. The frame flower display according to claim 1 wherein said frame further includes:

decorative wooden moldings joined in a rectangular configuration.

3. The frame flower display according to claim 1 wherein said frame further includes:

a first subframe having a flanged edge; and, a second subframe joined to said first subframe.

4. The frame flower display according to claim 1 wherein said watertight container is comprised of a plastic material.

5. The frame flower display according to claim 1 wherein said first upright panel has a height substantially equivalent to that of said container.

6. The frame flower display according to claim 1 wherein each of said first and said second upright panels are comprised of cardboard.

7. The frame flower display according to claim 1 further including:

a decorative fabric covering fastening to the front of said first upright panel.

8. The frame flower display according to claim 1 further including:

a decorative fabric covering fastened to the front of card second upright panel.

9. The frame flower display according to claim 1 further including:

a hook joined to said second upright panel for retaining said display upon a vertical support surface.

10. A frame flower display for exhibiting and retaining a floral arrangement upon a vertical support surface, comprising:

a frame constructed of decorative wooden moldings joined in a rectangular configuration;

a watertight container comprised of a plastic material, removably fitted within said frame, and adapted to receive stems of a floral arrangement, said container having an elevated ridge about its side and lower surfaces;

a first upright panel vertically retained within said frame and concealing said container from view, said first panel having a height substantially equivalent to that of said container;

a second upright panel removably joined to said frame forming the rear closure thereof;

a decorative fabric covering fastened to the front of said first upright panel;

a decorative fabric covering fastened to the front of said second upright panel; and, a hook joined to said second upright panel for retaining said display upon a vertical support surface.

* * * * *